United States Patent [19]

Martin

[11] 4,309,743

[45] Jan. 5, 1982

[54] INTERMITTENT LIGHT MOVEMENT JEWELRY PENDANT

[76] Inventor: Danny W. Martin, 2704 Brookridge La., St. Charles, Mo. 63301

[21] Appl. No.: 22,191

[22] Filed: Mar. 20, 1979

[51] Int. Cl.[3] ..... F21L 15/08; A44C 7/00; H01H 35/02

[52] U.S. Cl. ..... 362/104; 63/13; 200/61.57

[58] Field of Search ..... 362/104, 806–811, 362/103, 195; 200/61.45 R, 61.52, 61.83; 63/12, 13

[56] References Cited

U.S. PATENT DOCUMENTS 2,798,148 7/1957 Di Lizio et al. ..... 362/103

3,392,276 7/1968 Roman ..... 362/802 X

*Primary Examiner*—L. T. Hix

*Assistant Examiner*—Thomas H. Tarcza

*Attorney, Agent, or Firm*—Warren H. Kintzinger

[57] ABSTRACT

An ornamental article of jewelry having an internally lighted pendant housing suspended from a necklace or bracelet for free irregular movement with body movement of the wearer. The internally lighted pendant housing encloses small batteries at the bottom and thereabove a low current demand light emitting structure that is subject to intermittent jiggled tilting to complete the battery-light circuit.

10 Claims, 5 Drawing Figures

INTERMITTENT LIGHT MOVEMENT JEWELRY PENDANT

Figure 1:
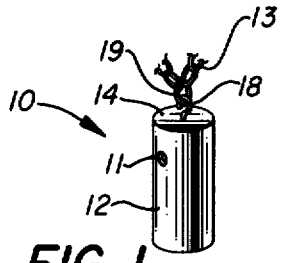

This invention relates in general to jewelry with lighting, and more particularly, to internally lighted jewelry such as a movement actuated intermittent light equipped pendant suspended from a necklace or bracelet.

In designing jewelry artistic endeavor has assumed many forms with lighting and light highlighting being an area of recent development such as with costumes and for on the stage devices. With the advent of low current low intensity lighting devices such as light emitting diodes the door to the use of lighting is opened for use of light in jewelry in the artistic sense with esthetically pleasing results in tastefully executed jewelry quite suitable for most any woman. Further, tastefully subdued jewelry lighting is made more intriguingly attractive with intermittent body movement jiggled actuated internal to external lights as an accentuation ingredient in jewelry.

It is, therefore, a principal object of this invention to provide internally lighted jewelry with light accentuation on an intermittently actuated basis.

Another object is to provide such internally lighted jewelry with a low current demand low intensity subdued intermittent lighting.

A further object is to provide such jewelry with internal batteries yielding reasonably long life in use.

Still another object is to provide intermittent lighted jewelry with lighting on an intermittent basis actuated by body movement.

Features of the invention useful in accomplishing the above objects include, in a body movement actuated intermittent light equipped pendant suspended from a necklace or bracelet, an internally lighted pendant housing suspended from a necklace or bracelet for free irregular movement with body movement of the wearer. The pendant could also be suspended from jewelry clips, ornamental combs, earring clips and any other items of jewelry that may be worn and from which the pendant housing would be suspended for free irregular movement. The internally lighted pendant includes a housing enclosing small batteries at the bottom and thereabove a low current demand light emitting structure that may be such as a light emitting diode structure that is subject to intermittent jiggled tilting to intermittently actuate the light by repeated completing and breaking the battery-light circuit.

A specific embodiment representing what is presently regarded as the best mode of carrying out the invention is illustrated in the accompanying drawing.

Figure 3:
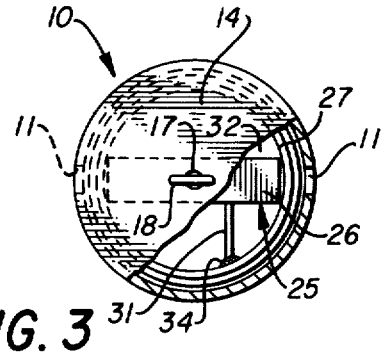
Figure 2:
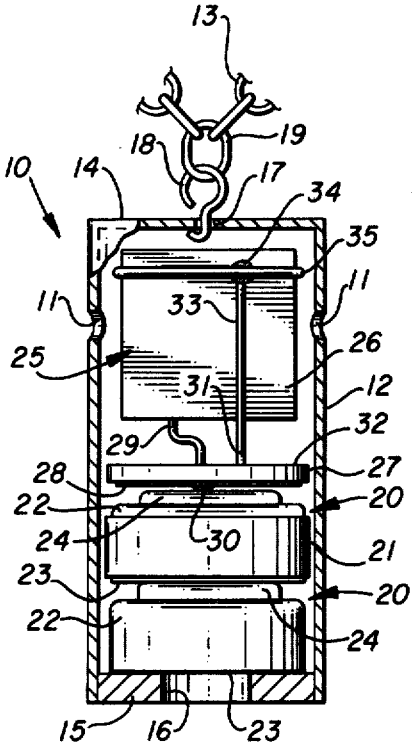
Figure 4:
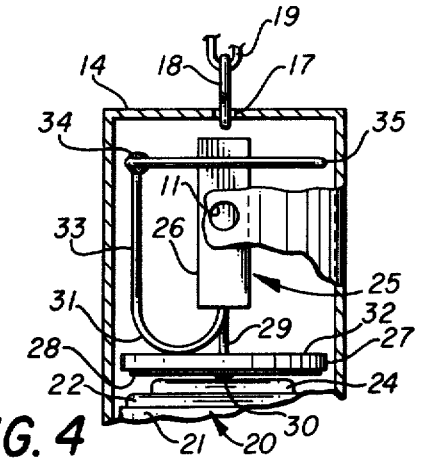
Figure 5:
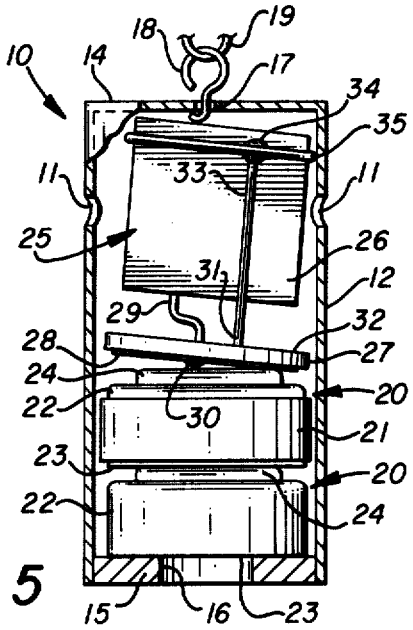

In the drawing:

FIG. 1 represents a perspective view of a jewelry pendant in the form of a housing having a light port and suspended from a chain link necklace or bracelet;

FIG. 2, a partially cut away and sectioned side elevation view of the jewelry pendant housing of FIG. 1 showing internal housing detail, batteries and the light emitting structure above the batteries within the housing;

FIG. 3, a partially cut away and sectioned top plan view of the jewelry pendant of FIGS. 1 and 2;

FIG. 4, a partially cut away and sectioned side elevation view of the jewelry pendant rotated ninety degrees from the showing of FIG. 2; and, FIG. 5, a partially cut away and sectioned side elevation view of the jewelry pendant with in this instance the light emitting structure jiggled shifted from the non-completed battery light circuit state of FIGS. 2 and 4 to a circuit completed state.

Referring to the drawing:

The internally lighted jewelry pendant 10 of FIG. 1, having a light port 11 in the wall of the pendant cylindrical housing 12, is suspended from a link chain necklace 13 connected to a pendant housing top 14. The necklace 13 could be instead a bracelet, jewelry clip, earring, comb or other jewelry item from which a jewelry pendant 10 could be suspended.

Referring also to FIGS. 2–5, the jewelry pendant 10 is shown to be in the form of a cylinder with a conductive metal cylindrical housing 12 closed at the top with end wall 14 and at the bottom by an electrically conductive aluminum plug 15 having a bottom opening 16. The pendant 10 has a hole 17 in the top center for the mounting of a top hook 18 useful for fastening of the pendant 10 to a link 19 of necklace 13, or of a bracelet, for the suspended mounting of the pendant 10. At least one battery 20 is supported on aluminum plug 15 within cylindrical housing 12 but if plurality of batteries 20 are used in series, such as with the two batteries 20 shown, then the batteries 20 above the lowest battery must each have its outer circumference covered with an electrical insulation material band 21 to prevent shorting of the circuit through the battery or batteries therebeneath. The batteries used are such as hearing aid batteries of the small silver oxide 1.5 volt disc type batteries (Eveready No. S312E-6 being an illustrative example of such batteries commercially available on the market). With such batteries the cylindrical metal side 22 and bottom 23 is one terminal and a top projection 24 is the other terminal. A light emitting structure 25 is also contained within the pendant cylindrical housing 12 above and resting on the top terminal projection 24 of the top battery 20.

The light emitting structure 25 includes a low current demand light emitting device 26, such as a light emitting diode, many versions of which are well known and available on the commercial market. Device 26 is mounted on and above a clad insulative material board 27 in the form of a circular disc of less diameter than the internal diameter of the cylindrical housing 12 such as to permit jiggling circuit intermittent closing and opening of the battery-light circuit. The circular disc clad board 27 is provided with a conductive material, circular clad disc 28 on the bottom thereof of less diameter than the clad board 27 disc, to insure conductive circuit contact generally with the top terminal projection 24 of the uppermost battery 20. A terminal wire 29 extends through the clad board 27 to a solder connection 30 with conductive material disc 28 and also upward as circuit terminal and mounting support of light emitting devide 26. The other terminal connection wire 31 of device 26 extends down to a curve thereof resting on the top 32 of board 27 for additional device 26 support and then vertically upward with extension 33 to a top end soldered connection 34 with a conductive metal circular contact ring 35 that is smaller in diameter than the inner diameter of the cylindrical housing 12. This is such as to facilitate jiggled movement of the light emitting structure 25 from the disconnected battery-light circuit state of FIGS. 2, 3 and 4 to the completed battery-light circuit state of FIG. 5 where the ring 35 is temporarily intermittently in contact with the electrically conductive wall of cylinder housing 12. Electrical contact ring 35 also lends structural support to light emitting device 26 in corner mutual encircling contact therewith.

The light emitting structure 25 is so sized and structured as to be generally balanced upon the top terminal projection 24 of the top battery 20 with the solder connection 20 and/or the clad disc 28 generally one or the other maintaining circuit contact for terminal wire 29. The balance of light emitting structure 25 is such on battery terminal 24 as to permit jiggled movement of the structure 25 bringing contact ring 35 into repeated momentary intermittent contact with the conductive material wall of cylindrical housing 12 from which position the balance of the structure 25, particularly with any lifting of the solder connection 30 from upper battery terminal 24, tends to bring return of structure 25 to a more upright state. When the solder connection 30 is lifted from contact with the upper battery terminal 24 the support point of contact of clad disc 28 is so displaced outside the center of balance of light structure 25 as to immediately bias the structure 25 away from electrical contact ring 35 contact with the wall of housing 12. Thus, body movement induced brief intermittent contact of electrical contact ring 35 with the wall housing 12 making and breaking the battery-light circuit results in a teasing and intriguingly attractive actuation of lighting from light emitting structure 25 shining through port openings 11. Obviously, one or more parts 11, such as the two ports 11 shown, may be used that may include glass or other transparent and/or colored inserts. Transparent and/or translucent panels may also be used in a housing 12 for different desired aesthetic effects.

Whereas this invention has been described with respect to several embodiments thereof, it should be realized that various changes may be made without departing from the essential contributions to the art made by the teachings hereof.

I claim:

1. In an article of jewelry having intermittent lighting: housing means; battery means contained within said housing means; light means; battery to light circuit means; circuit completing and breaking structural means contained within said housing means as part of said battery to light circuit means; and with said circuit completing and breaking structural means and said light means forming a balanced structure supported on said battery means for tilting movement thereof with movement of the article of jewelry; said balanced structure being in its circuit breaking condition when balanced and in its circuit completing condition when unbalanced by being tilted in any direction; and with tilting of said balanced structure to a circuit completing position on an intermittent basis and lighting of said light means on an intermittent basis induced by movement of the article of jewelry.

2. The article of jewelry of claim 1, wherein said structural means mounts said light means within said housing means; and said housing means includes interior to exterior light passage means.

3. The article of jewelry of claim 2, wherein said housing means is in the form of an ornamental pendant; and further including mounting means for carrying said pendant as an article of jewelry on the body of the wearer for free irregular movement with body movement of the wearer.

4. The article of jewelry of claim 3, wherein said mounting means includes chain means suspending said housing means pendant.

5. The article of jewelry of claim 2, wherein said light means is a low current demand light emitting diode.

6. The article of jewelry of claim 2, wherein said structural means has a support base resting on an uppermost battery terminal; said light means has a first terminal and a second terminal; said support base including a clad board with conductive metal cladding on the bottom of an insulation material board; extension of said first terminal from said light means supported above said board to electrically conductive contact with said cladding below the board; and extension of said second terminal to electric circuit contact means positioned to close circuit contact with circuit contact means in closing said battery to light circuit means for intermittent lighting of said light means with movement of said housing means.

7. The article of jewelry of claim 6, wherein said circuit contact means is an electrically conductive portion of the interior surface of said housing means; and with said housing providing an electrically conductive path from a bottom terminal connection with said battery means to said electrically conductive portion of the housing means.

8. The article of jewelry of claim 7, wherein said battery means is a plurality of batteries of the relatively small flat type stacked in electrically seriesed relation; and a band of electrically insulating material around the circumference of each battery above the bottom battery of said plurality of stacked batteries.

9. The article of jewelry of claim 6, wherein said electric circuit contact means is an electrically conductive ring connected to said second terminal, and positioned to contact conductive means in contact with second battery terminal means.

10. The article of jewelry of claim 9, wherein said electrically conductive ring is positioned adjacent the top of said light means, around said light means and in contact with said light means; and with said first and second light terminals supporting said light means above said insulation material board.

* * * * *